US006082065A

United States Patent [19]

Feldpausch

[11] Patent Number: 6,082,065

[45] Date of Patent: Jul. 4, 2000

[54] CONNECTOR FOR PARTITION SYSTEM

[75] Inventor: Michael J. Feldpausch, Hastings, Mich.

[73] Assignee: Steelcase Development Inc., Grand Rapids, Mich.

[21] Appl. No.: 09/132,137

[22] Filed: Aug. 10, 1998

[51] Int. Cl.[7] ..... E04H 1/00

[52] U.S. Cl. ..... 52/239; 52/238.1; 52/285.1; 52/285.3; 52/582.1; 52/713

[58] Field of Search ..... 52/713, 238.1, 52/239, 285.3, 285.1, 582.1

[56] References Cited

U.S. PATENT DOCUMENTS

| | | |
|---|---|---|
| D. 350,401 | 9/1994 | Kok . |
| 2,121,213 | 6/1938 | Small . |
| 2,576,865 | 11/1951 | Vanderveld . |
| 2,741,449 | 4/1956 | Heselov . |
| 3,055,462 | 9/1962 | Steele . |
| 3,066,770 | 12/1962 | Millard et al. . |
| 3,087,702 | 4/1963 | Anderson . |

(List continued on next page.)

OTHER PUBLICATIONS

Progetto 25.90 by Unifor, Inc., U.S.A., Long Island City, New York; date unknown (prior to Jan. 1, 1991) (5 pages).

Panneli PL by Unifor, Inc., U.S.A., Long Island City, New York, date unknown (prior to Jul. 26, 1996) (35 pages).

Teknion—Office Furniture Systems 440905, Price List, Apr. 1983 (31 pages).

Exhibit A is a brochure entitled *Knoll—Hanna Desk System*, 18 pages, dated Oct. 1986.

Exhibit B is a brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

Exhibit A discloses a freestanding partition system installed in a public location by Steelcase more than one year prior to filing the present application (5 pages).

Exhibit B discloses a prior art bracket arrangement installed in a public location by Steelcase more than one year prior to filing the present application (4 pages).

*Primary Examiner*—Christopher T. Kent
*Assistant Examiner*—Nkeisha J. Maddox
*Attorney, Agent, or Firm*—Price Heneveld Cooper DeWitt & Litton

[57] ABSTRACT

A bracket is provided for attaching an end of a first partition to a face of a second partition at a selected location intermediate vertical side edges of the second partition, where the second partition includes a horizontal frame member having a horizontal row of slots. The bracket includes an L-shaped rigid member stamped from rigid sheet metal having a first horizontal leg and a first vertical leg, with the first horizontal leg having hooks each with a notch configured to securely engage selected slots on the second partition. The bracket further includes an L-shaped interlock member stamped from spring steel having a second horizontal leg and a second vertical leg. The second horizontal and vertical legs lay on the first horizontal and vertical legs, respectively, and the second horizontal leg has an interlock tab that extends to and overlaps a rear of one of the hooks. The interlock tab is configured to prevent the hooks from disengaging from the horizontal frame member when the hooks are engaged with selected ones of the slots. The second vertical leg is attached to the first vertical leg at a location spaced from the second horizontal leg, so that a portion of the second horizontal leg can be flexed to move the interlock tab to a non-interlocked position spaced away from the hooks to fully reveal the hooks for engagement with selected ones of the slots, but the portion is resilient and configured to bias the interlock tab into a normally interlocked position overlaying the hooks to prevent the hooks from being accidentally disengaged from the selected slots.

23 Claims, 4 Drawing Sheets

U.S. PATENT DOCUMENTS 3,097,822 7/1963 Attwood .
3,101,817 8/1963 Radek .
3,199,822 8/1965 Ruhnke .
3,299,839 1/1967 Nordbak .
3,330,583 7/1967 Kennedy et al. .
3,378,977 4/1968 Vervloet .
3,408,127 10/1968 Vincens .
3,425,568 2/1969 Albright .
3,514,883 6/1970 Albright .
3,565,381 2/1971 Oliver .
3,733,755 5/1973 Butler .
3,802,146 4/1974 Tacke et al. .
3,834,093 9/1974 Tacke et al. .
3,858,988 1/1975 Cohen .
4,018,167 4/1977 Spangler .
4,035,972 7/1977 Timmons .
4,103,465 8/1978 McDonald, Jr. .
4,129,279 12/1978 Burkholder .
4,185,422 1/1980 Radek .
4,198,913 4/1980 Haworth et al. .
4,205,815 6/1980 Sauer et al. .
4,378,925 4/1983 Griffin .
4,423,573 1/1984 Omholt et al. .
4,535,577 8/1985 Tenser et al. .
4,562,656 1/1986 Kristofich .
4,571,906 2/1986 Ashton .
4,619,486 10/1986 Hannah et al. .
4,625,483 12/1986 Zacky et al. .
4,631,881 12/1986 Charman .
4,662,135 5/1987 Tanikawa et al. .
4,662,136 5/1987 Tanikawa et al. .
4,685,255 8/1987 Kelley .
4,709,517 12/1987 Mitchell et al. .
4,712,336 12/1987 Backer .
4,730,740 3/1988 Winter et al. .
4,731,960 3/1988 Sease .
4,831,791 5/1989 Ball .
4,874,148 10/1989 Guinter .
4,883,330 11/1989 Armstrong et al. .
4,928,467 5/1990 Hintsa .
5,005,325 4/1991 Dull et al. .
5,038,534 8/1991 Pollock .
5,054,255 10/1991 Maninfior .
5,062,246 11/1991 Sykes .
5,117,599 6/1992 Voss .
5,134,826 8/1992 La Roche et al. .
5,142,832 9/1992 Branham, Sr. et al. .
5,175,969 1/1993 Knauf et al. .
5,209,035 5/1993 Hodges et al. .
5,212,918 5/1993 Newhouse et al. .
5,239,798 8/1993 Saito .
5,277,007 1/1994 Hellwig et al. .
5,285,602 2/1994 Felton .
5,287,666 2/1994 Frascaroli et al. .
5,309,686 5/1994 Underwood et al. .
5,341,615 8/1994 Hodges et al. .
5,377,466 1/1995 Insalaco et al. .
5,394,658 3/1995 Schreiner et al. .
5,400,560 3/1995 Hellwig et al. .
5,406,760 4/1995 Edwards .
5,426,904 6/1995 Gilmore .
5,430,984 7/1995 Young et al. .
5,437,426 8/1995 MacDonald .
5,487,246 1/1996 Hodges et al. .
5,746,034 5/1998 Luchetti et al. .
5,746,035 5/1998 Seiber et al. .
B1 4,876,835 6/1992 Kelly et al. .

CONNECTOR FOR PARTITION SYSTEM

BACKGROUND OF THE INVENTION

The present invention relates to a connector for connecting a first partition at an angle to a face of a second partition, and more particularly concerns a self-locking connector adapted to interlockingly engage a mating structure on the first and second partitions to retain the partitions together.

It is desirable to use self-locking connectors for interconnecting partitions for many reasons. The self-locking connectors are more secure than connectors that are not locked in position, such that they provide improved safety when interconnecting partitions. Further, self-locking connectors are less likely to be improperly installed by installers if properly designed. Nonetheless, it is preferable that they do not increase the number of parts required for assembly and that they be easy to manufacture and use.

U.S. Pat. No. 5,487,246 shows an existing partition system that includes partitions having a vertical row of slots located at opposing ends of the partitions, which slots are accessible from a front of the partitions. However, in partition systems having vertical rows of slots, the forces of engagement by hooks into the slots are vertical, such that the hooks tend to be held in the slots with gravity. Another aspect, in our opinion based on our experience and testing, is that vertical gaps are "more visible" than horizontal gaps or at least more sensitive to visual recognition by users of dimensional inconsistency. Accordingly, the vertical gaps can be larger in width and/or less uniform than horizontal features without being objectionable. This makes it more difficult to provide an interlock feature on the connector that is able to function well with a horizontal gap that must simultaneously also be very uniform and narrow in width.

Accordingly, a connection system for partitions is desired solving the aforementioned problems and having the aforementioned advantages, and that is adapted to function properly given the constraints of a horizontally extending feature for receiving the connectors.

SUMMARY OF THE INVENTION

In one aspect of the present invention, a connector bracket is provided for attaching an end of a first partition to a face of a second partition at a selected location intermediate vertical side edges of the second partition, where the second partition includes a horizontal frame member having a horizontal row of slots. The connector includes an L-shaped rigid member having a first horizontal leg and a first vertical leg, with the first horizontal leg having hooks each with a notch therein, the first vertical leg being spaced from the notches and including a connector adapted for attachment to the end of the first partition. The connector further includes an L-shaped interlock member having a second horizontal leg and a second vertical leg. The second horizontal and vertical legs lay on the first horizontal and vertical legs, respectively, and the second horizontal leg has an interlock tab that extends adjacent a portion of one of the hooks. The interlock tab is configured to prevent the hooks from disengaging from the horizontal frame member when the hooks are engaged with selected ones of the slots. The second vertical leg is attached to the first vertical leg at a location spaced from the second horizontal leg, so that a portion of the second vertical leg can be flexed to move the interlock tab to a non-interlocked position spaced away from the hooks to fully reveal the hooks for engagement with selected ones of the slots, but the portion is resilient and configured to bias the interlock tab into a normally interlocked position adjacent to the hooks to prevent the hooks from being accidentally disengaged from the selected slots.

In another aspect of the present invention, an apparatus is provided for attachment to an existing partition that includes a face and a horizontal frame member defining a horizontal row of slots along the face. The apparatus includes an off-module partition having an end located at a selected location between opposing vertical side edges of the existing partition, and a connector bracket for interconnecting the end of the off-module partition to the face of the existing partition. The connector bracket includes a rigid member having a first leg and a second leg. The first leg includes hooks each with a notch therein, and the second leg is spaced from the notches and configured to engage the end of the off-module partition and secured thereto. The connector bracket further includes an interlock member having a third leg and a fourth leg. The third and fourth legs lay adjacent the first and second legs, respectively. The third leg has an interlock tab that is adjacent to at least one of the hooks. The interlock tab is configured to prevent the hooks from disengaging from the horizontal frame member when the hooks are engaged with selected ones of the slots. The fourth leg is attached to the second leg at a location spaced from the third leg, so that a portion of the fourth leg can be flexed to move the interlock tab to a non-interlocked position spaced away from the hooks to fully reveal the hooks for engagement with selected ones of the slots, but the portion is resilient and configured to bias the interlock tab into a normally interlocked position adjacent the hooks to prevent the hooks from being accidentally disengaged from the selected slots.

In another aspect of the present invention, a connector bracket is provided for attaching an end of a first partition to a face of a second partition at a selected location between vertical side edges of the second partition, where the second partition includes a horizontal frame member having a horizontal row of slots. The connector bracket includes a rigid member including a first leg and a second leg extending at an angle to the first leg. The first leg has hooks and the second leg includes marginal material elongated and threaded to form an elongated surface for receiving a threaded fastener. The connector bracket still further includes an interlock member including an interlock tab that extends adjacent at least a portion of one of the hooks. The interlock tab is configured to prevent the hooks from disengaging from the horizontal frame member when the hooks are engaged with selected ones of the slots. The interlock member is attached to the second leg at a location spaced from the hooks, so that a portion of the interlock member can be flexed to move the interlock tab to a non-interlocked position spaced away from the hooks to fully reveal the hooks for engagement with selected ones of the slots, but the portion is resilient and configured to bias the interlock tab into a normally interlocked position adjacent the hooks to prevent the hooks from accidentally disengaging from the selected slots.

In yet another aspect of the present invention, a method is provided for interconnecting an off-module partition to an existing partition, where the existing partition has a face and opposing vertical side edges, and further has a horizontal frame member having a horizontal row of slots therein. The method includes steps of providing an off-module partition with an end, and providing a connector having a rigid member including hooks for selective attachment to the slots and including an apertured end constructed to receive a fastener. The connector includes an interlock member with an interlock tab configured to interlockingly engage the horizontal frame member. The method further includes attaching the connector to the existing partition by extending the hooks into engagement with selected slots, and then sliding the connector horizontally laterally to engage the hooks with the selected slots. The method still further includes flexing the interlock member from an interlocked position to a non-interlocked position as the hooks are inserted, so that an interlock tab on the interlock member does not interfere with inserting the hooks. The interlock member is thereafter moved from the non-interlocked position back to the interlocked position after the hooks are laterally seated in the selected slots to interlock the connector in the existing partition. The method also includes extending a fastener into the apertured end to connect the end of the off-module partition to the connector and in turn to the existing partition.

These and other aspects, objects, and advantages of the present invention will be further understood by persons skilled in the art upon review of the following specification, claims, and appended drawings.

DETAILED DESCRIPTION OF PREFERRED EMBODIMENTS

Figure 1:
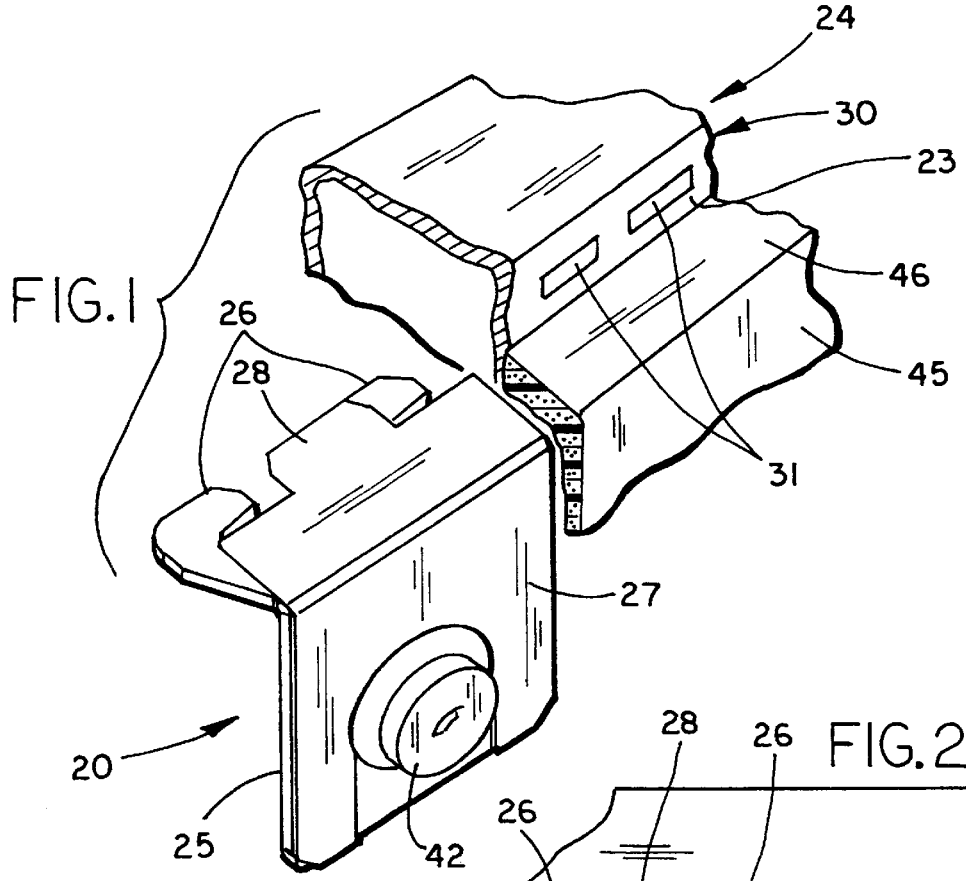
FIG. 1 is a perspective view of a partition partially broken away to show the position and engagement of the present connector with the partition.
Figure 2:
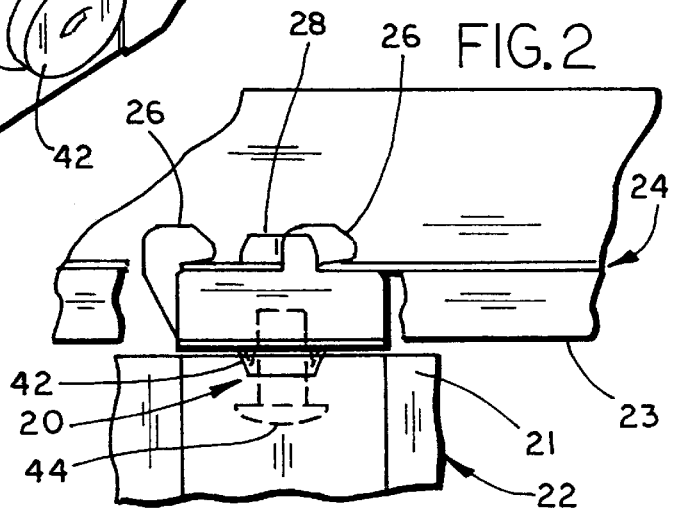
FIGS. 2–4 are top, front, and side fragmentary cross-sectional views of the connector defined in FIG. 1.

A connector 20 (FIG. 1) embodying the present invention is provided for attaching an end 21 of a first partition 22 to a cover 23 forming a face of a second partition 24 at a selected location, such as at an intermediate "off-module" location between vertical side edges of the second partition 24. The connector 20 includes an L-shaped rigid member 25 adapted with hooks 26 configured to horizontally engage a horizontal row of slots 31 in the second partition 24, and further includes an L-shaped interlock member 27 that can be flexed to move an interlock tab 28 on the interlock member 27 to a non-interlocked position spaced away from the hooks 26 to fully reveal the hooks 26 for engagement with selected ones of slots 31 in the second partition 24. In particular, the interlock member 27 is resilient and configured to bias the interlock tab 28 into a normally interlocked position overlaying the hooks 26 to prevent the hooks 26 from being accidentally horizontally disengaged from the selected slots 31, as described below. It is noted that the interlock tab 28 does not necessarily need to overlap the hooks 26, as illustrated below in the embodiment 20A of FIGS. 14–35.

The second partition 24 (FIG. 1) includes a horizontal frame member 30 having the horizontal row of slots 31. The frame member 30 can have any number of different shapes and constructions. An exemplary preferred partition having several different horizontal frame members is shown in a United States patent application entitled *Partition Construction Including Interconnection System and Removable Covers*, application Ser. No. 08/687,724, filed Jul. 26, 1996, the entire contents of which are incorporated by reference herein. The preferred frame member 30 includes a vertical outer planar face with each of the slots 31 having a unit length and being separated by the same unit length. For example, in the United States, the unit is about one-half inch long, thus positioning the slots at one-inch intervals. This facilitates accurate positioning of the partitions 22 and 24 without the need to accurately measure every connection with a tape measure. The partitions 24 are covered by removable cover panels 45 having edges 46 that define an access gap 47 to the slots 31. The access gap 47 can be any size desired, such as, as thin as 0.200 to 0.300 inches or less.

Figure 8:
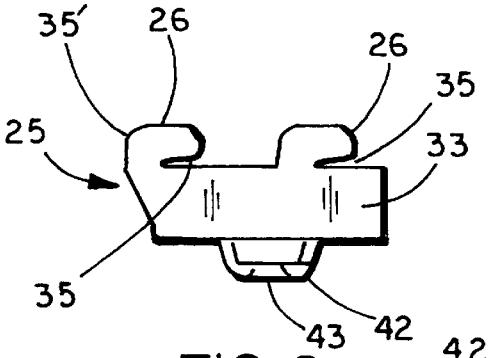
FIGS. 8–10 are top, front, and side views of the L-shaped rigid member shown in FIG. 1.
Figure 9:
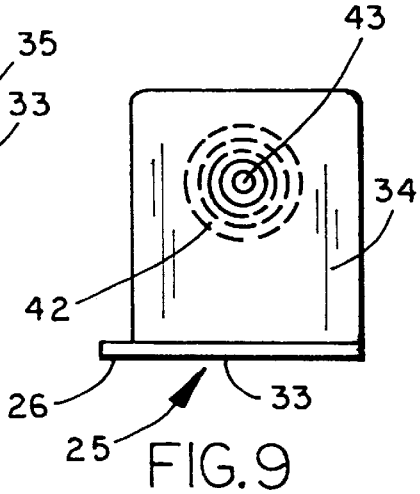
Figure 10:
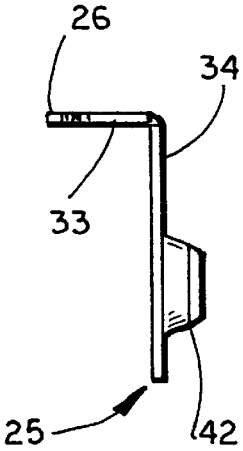

The L-shaped rigid member 25 (FIGS. 8–10) is stamped from stiff sheet metal, steel, or other material having a strength necessary to provide the retention strength desired for a particular set of design criteria, such as 0.070 to 0.079-inch thick cold rolled steel. The rigid member 25 has a first horizontal leg 33 and a first vertical leg 34. The first horizontal leg 33 has a pair of fingers forming the hooks 26, each with a thin notch 35 configured to securely engage selected slots 31 on the second partition 24. The hooks 26 have corners 35' rounded off, so that they can be easily slid into position in the slots 31 of second partition 24, and further the notches 35 are shaped to prevent easy removal of the connector 20 from the partition 24 until the connector 20 is slid laterally in a direction parallel the face of the partition 24 to release the hooks 26 from the slots 31. An extruded and reversely bent section 42 on vertical leg 34 forms a hole 43 for receiving an attachment screw 44 for securing the end 21 of first partition 22 to the connector 20.

Figure 11:
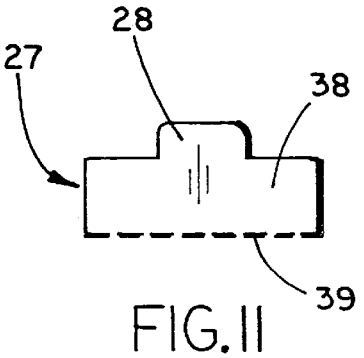
FIGS. 11–13 are top, front, and side views of the L-shaped flexible interlock member shown in FIG. 1.
Figure 12:
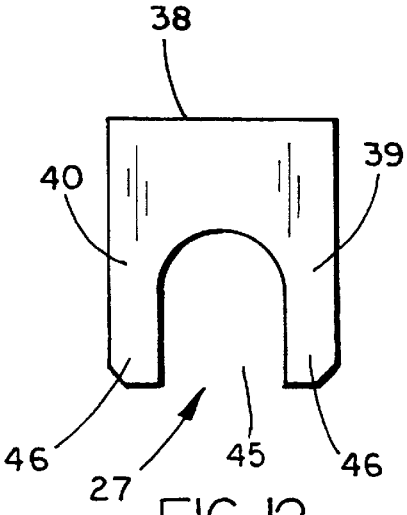
Figure 13:
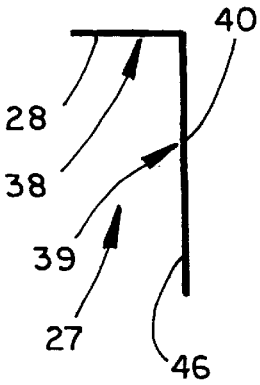
Figure 14:
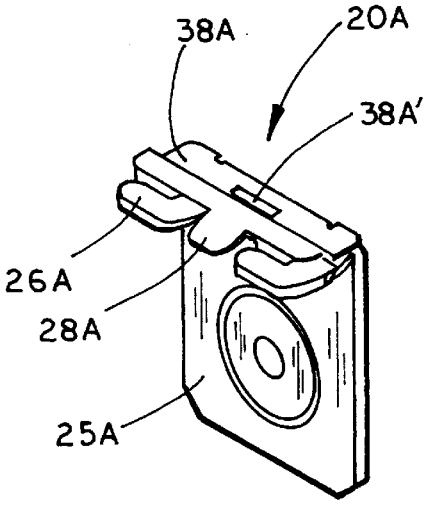
FIG. 14 is a perspective view showing a modified connector.
Figure 15:
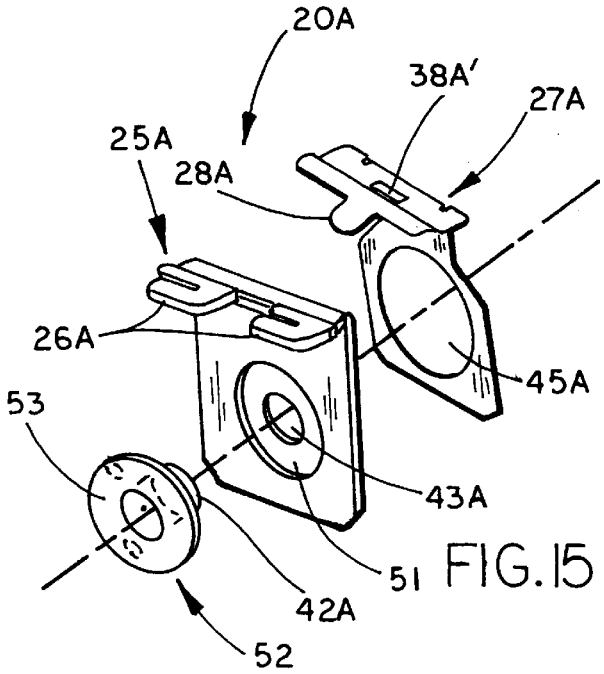
FIG. 15 is an exploded view of the connector shown in FIG. 14.
Figure 16:
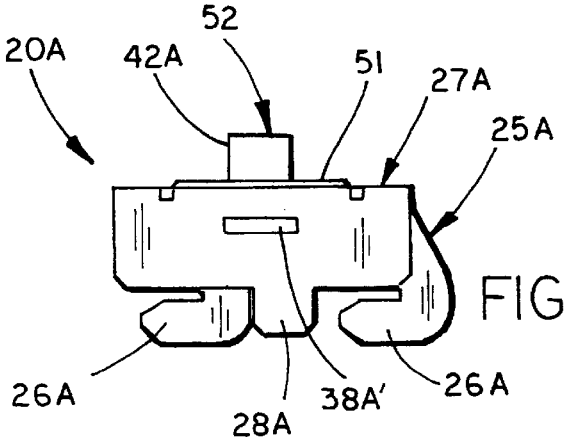
FIGS. 16–18 are top, front, and side fragmentary cross-sectional views of the connector defined in FIG. 14.
Figure 19:
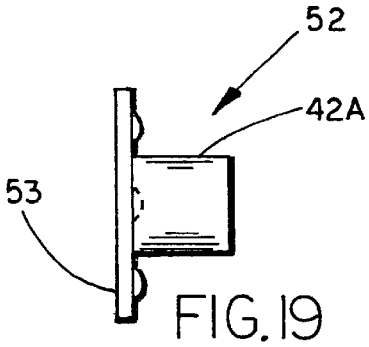
FIG. 19 is a side view of the threaded member shown in FIG. 15.
Figure 17:
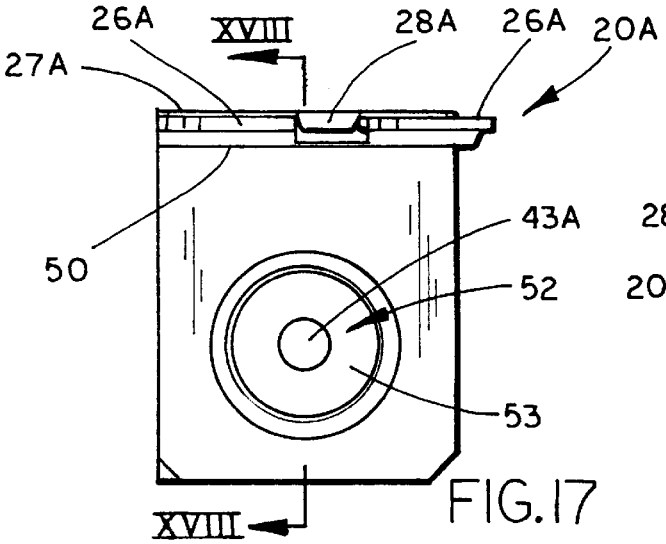
Figure 18:
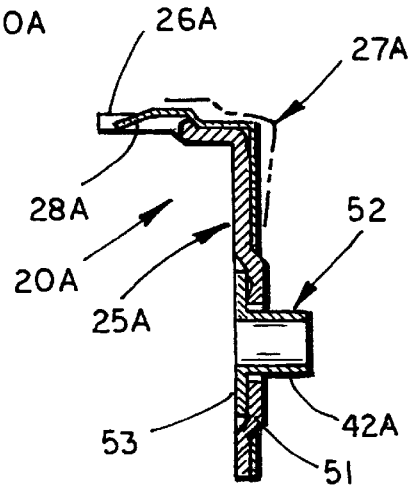
Figure 20:
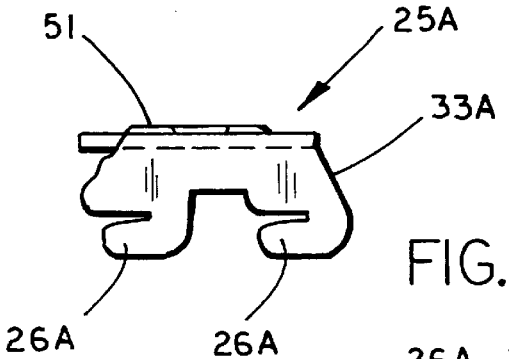
FIGS. 20–22 are top, front, and side views of the L-shaped rigid member shown in FIG. 15.
Figure 21:
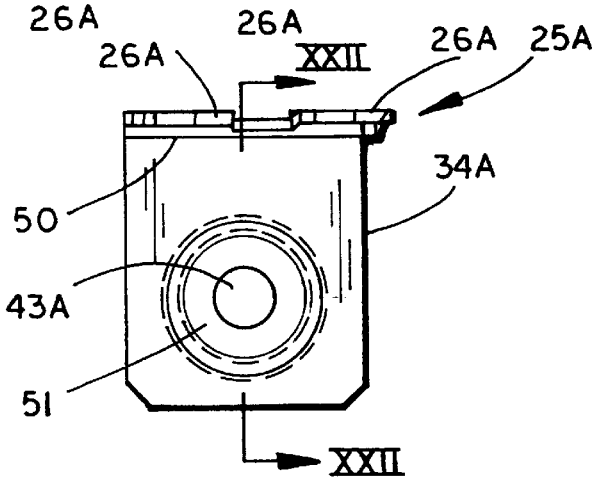
Figure 22:
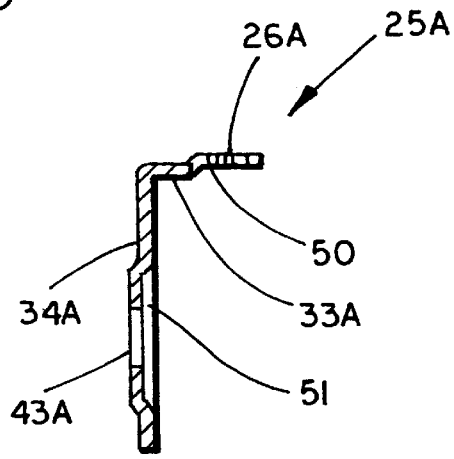
Figure 23:
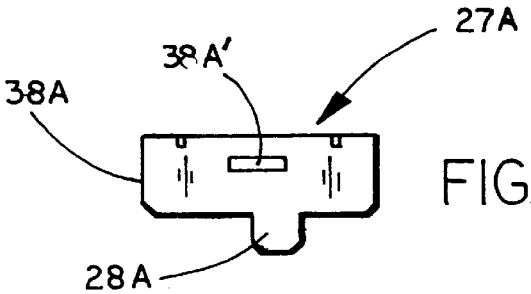
FIG. 23–25 are top, front, and side views of the L-shaped flexible interlock member shown in FIG. 15.
Figure 24:
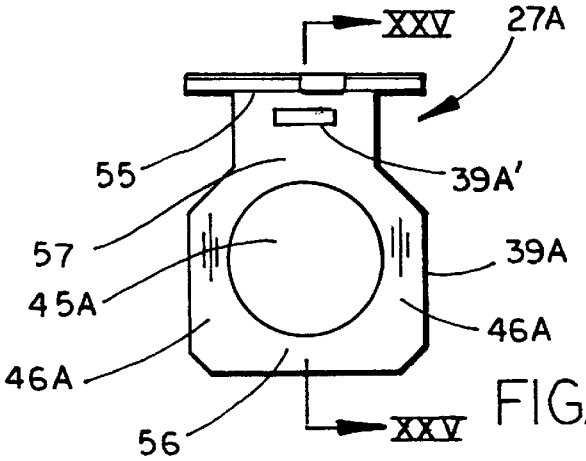
Figure 25:
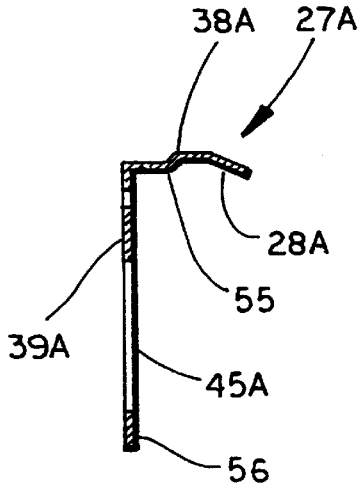

The L-shaped interlock member 27 (FIGS. 11–13) is stamped from spring steel or is formed from another resilient material such as martensite having sufficient strength to interlockingly hold the hooks 26 in the slots 31 while maintaining the minimum thickness and resiliency necessary for a particular set of design criteria. It is contemplated that the interlock member could be made from spring steel having a thickness of about 0.021 to 0.027 inches martensite, for example. The interlock member 27 has a second horizontal leg 38 and a second vertical leg 39. The second horizontal and vertical legs 38 and 39 lay on the first horizontal and vertical legs 33 and 34, respectively. The second horizontal leg 38 has the interlock tab 28 that extends to and overlaps a rear of one of the hooks 26 at a location opposite to a throat of the notch 35. By this arrangement, the interlock tab 28 is configured to prevent the hooks 26 from disengaging from selected slots 31 on the horizontal frame member 30 when the hooks 26 are engaged with selected ones of the slots 31. The second vertical leg 39 is attached to the first vertical leg 34 at a location spaced from the second horizontal leg 38, so that a portion 40 of the second horizontal leg 38 can be flexed to move the interlock tab 28 to a non-interlocked position spaced away from the hooks 26 to fully reveal the hooks 26 for engagement with selected ones of the slots 31, but the portion 40 is resilient and configured to bias the interlock tab 28 into a normally interlocked position overlaying the hooks 26 to prevent the hooks 26 from being accidentally disengaged from the selected slots 31. Specifically, the vertical leg 39 of the interlock member 27 includes a slot 45 that receives the extruded bent section 42 and includes leaf-spring-like leg portions 46 that straddle the extruded bent section 42.

The connector 20 is very compact such that it is low cost, yet it is very secure when properly installed. In particular, the total vertical thickness of the hook and tab area of the connector 20 is only about 0.100 total thickness. Further, the connector 20 is optimally suited and adapted to secure in the horizontal partition slots 31, and in particular, the horizontal legs 33 and 38 provide a very thin profile that minimizes the vertical width of the gap in a front face 23 of the partition 24, thus allowing the connector 20 to be used in a gap having a vertical dimension that is small enough not to be objectionable to a worker, such as a gap of only 0.200 to 0.300 inches or less.

A modified connector 20A (FIGS. 14 and 15) includes many features and components similar to connector 20. In connector 20A, identical or similar features are identified by the same number as were used to describe connector 20, except a letter "A" is added for connector 20A to reduce redundant discussion.

Connector 20A (FIG. 15) includes an L-shaped rigid member 25A with hooks 26A for engaging slots 31 (FIG. 1) in the partition 24, and further includes an L-shaped resilient interlock member 27A (FIG. 15) with an interlock tab 28A configured to retain the hooks 26A in selected slots 31.

Figure 4:
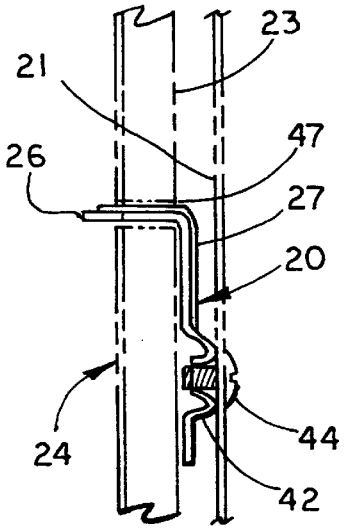
Figure 3:
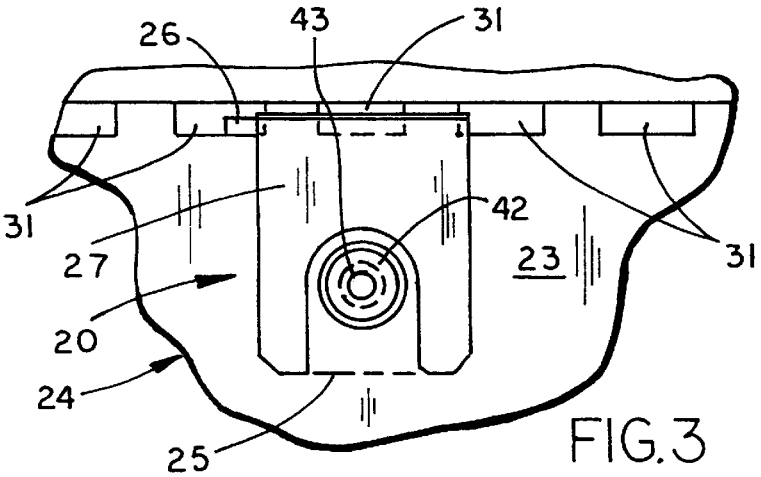
Figure 5:
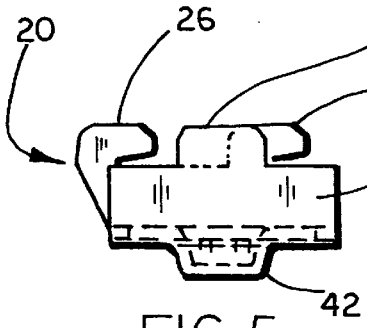
FIGS. 5–7 are top, front, and side views of the connector shown in FIG. 1, FIG. 7 showing the L-shaped resilient member in a normal interlocked position in solid lines and showing the resilient member in a flexed non-interlocked position in phantom lines.
Figure 7:
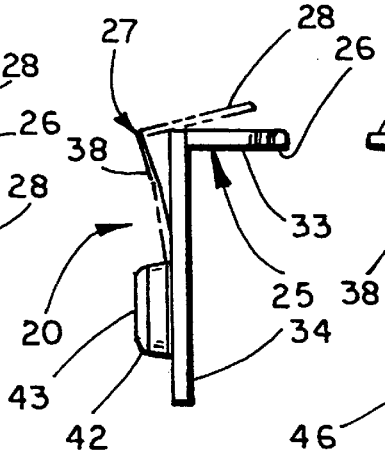
Figure 6:
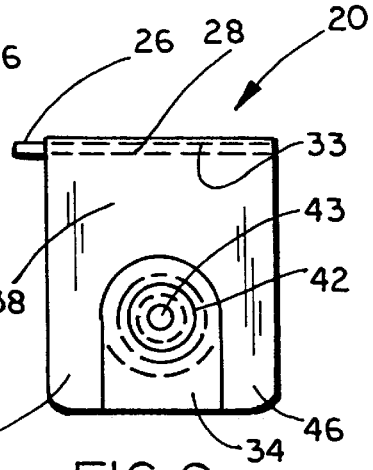

The rigid member 25A includes a horizontal leg 33A having an offset 50 formed laterally at a location spaced from the hooks 26A. The offset 50 adds stiffness to horizontal leg 33A, and further causes an outboard portion of the horizontal leg 33A to be located more closely to a top edge of a cover 23 (FIG. 4) aiding assembly and disassembly by reducing friction between hooks 26A and slot 31A. The vertical leg 34A includes an embossment 51 formed around the hole 43A. A threaded member 52 (FIG. 19) includes a washered end 53 that fits into embossment 51 and a threaded sleeve 42A that fits through the hole 43A. The washered end 53 includes embossments 53A that assist in welding it in place. The threaded sleeve 42A includes the marginal material defining the structure for receiving a thread screw 44 to attach the connector 20A to an end 21 of the first partition 22.

The interlock member 27A (FIGS. 23–25) includes a horizontal leg 38A having an offset 55 matching the offset 50 of rigid member 25A. It is noted that the interlock tab 28A is slightly smaller in width than tab 28 and does not overlap a rear edge of the hooks 26A. Tab 28A is downwardly angled and fits behind one of the hooks 26A. This assists in extending tab 28A into a slot 31 once the hooks 26A are shifted laterally to a fully seated/installed position in a frame member 30. Also, this angled orientation positions the tab 28A in the same plane as the hooks 26A, thus letting the hooks 26A abut and support the tab 28A when the tab 28A is in an interlocked position. The vertical leg 39A includes a lower section 56 that connects leg portions 46A. The upper section 57 of vertical leg 39A is necked for providing clearance for an installer's fingers to grasp rigid member 25A when interlock member 27A is flexed away from rigid member 25A. Tool access slots 38' and 39A' (FIGS. 23 and 24) are provided in legs 38A and 39A, respectively, to assist in disassembly and assembly, respectively.

The present connector includes an L-shaped rigid member with hooks on a horizontal leg shaped to horizontally engage a horizontal row of slots in a first partition and with a threaded horizontally facing hole on a vertical leg for receiving a screw to connect the first partition to a second partition. The connector further includes an L-shaped resilient interlock member having a tab on its horizontal leg configured to interlockingly hold the connector in secure engagement with the slots in the first partition. The connector is configured so that the hooks can be readily slid into selected slots while the interlock member is resiliently bent out of the way, with the bending being caused by engagement of the interlock tab against the frame of the second partition. Upon full insertion of the hooks, the interlock member resiliently biases the interlock tab into the slots to secure the hooks in the slots.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A connector bracket for attaching an end of a first partition to a face of a second partition at a selected location between vertical side edges of the second partition, where the second partition includes a horizontal frame member having a horizontal row of slots, comprising:

an L-shaped rigid member having a first horizontal leg and a first vertical leg, the first horizontal leg having hooks each with a notch therein, the first vertical leg being spaced from the notches and including a connector adapted for attachment to the end of the first partition; and an L-shaped interlock member having a second horizontal leg and a second vertical leg, the second horizontal and vertical legs laying on the first horizontal and vertical legs, respectively, the second horizontal leg having an interlock tab that extends adjacent a portion of one of the hooks, the interlock tab being configured to prevent the hooks from disengaging from the horizontal frame member when the hooks are engaged with selected ones of the slots, the second vertical leg being attached to the first vertical leg at a location spaced from the second horizontal leg, and a portion of the second vertical leg being resilient to permit moving the interlock tab to a non-interlocked position spaced away from the hooks to fully reveal the hooks for engagement with selected ones of the slots, the resilient portion configured to bias the interlock tab into a normally interlocked position adjacent to the hooks to prevent the hooks from being accidentally disengaged from the selected slots.

2. The connector bracket defined in claim 1 wherein the connector of the first vertical leg includes an aperture adapted to receive a fastener to attach the bracket to the first partition.

3. A connector bracket for attaching an end of a first partition to a face of a second partition at a selected location between vertical side edges of the second partition, where the second partition includes a horizontal frame member having a horizontal row of slots, comprising:

an L-shaped rigid member having a first horizontal leg and a first vertical leg, the first horizontal leg having hooks each with a notch therein, the first vertical leg being spaced from the notches and including a connector having marginal material defining an aperture and adapted to receive a fastener therein for attachment to the end of the first partition, the marginal material being extruded to form an elongated surface for engaging threads on the fastener; and an L-shaped interlock member having a second horizontal leg and a second vertical leg, the second horizontal and vertical legs laying on the first horizontal and vertical legs, respectively, the second horizontal leg having an interlock tab that extends adjacent a portion of one of the hooks, the interlock tab being configured to prevent the hooks from disengaging from the horizontal frame member when the hooks are engaged with selected ones of the slots, the second vertical leg being attached to the first vertical leg at a location spaced from the second horizontal leg, so that a portion of the second vertical leg can be flexed to move the interlock tab to a non-interlocked position spaced away from the hooks to fully reveal the hooks for engagement with selected ones of the slots, but the portion being resilient and configured to bias the interlock tab into a normally interlocked position adjacent to the hooks to prevent the hooks from being accidentally disengaged from the selected slots.

4. The connector bracket defined in claim 3 wherein the resilient member is made from one of martensite and spring steel.

5. The connector bracket defined in claim 4 wherein the marginal material includes a threaded member attached to the first vertical leg that is configured to receive a threaded fastener.

6. The connector bracket defined in claim 5 wherein the second vertical leg includes leg portions separated by an opening, the leg portions straddling the aperture.

7. The connector bracket defined in claim 6 wherein the leg portions are sufficient in length to flex like a leaf spring in a manner permitting the second horizontal leg including the tab to move to the non-interlocked position when the hooks are initially positioned in the slots.

8. The connector bracket defined in claim 7 wherein the leg portions are spot welded to the first vertical leg.

9. The connector defined in claim 8 wherein the interlock tab includes flat opposing edges, and the hooks include a rear edge opposite the notch that lies between the flat opposing edges when the interlock member is in the interlocked position.

10. The connector bracket defined in claim 9 wherein the rigid member includes two of the hooks and the resilient member includes a single one of the interlock tabs.

11. The connector bracket defined in claim 1 wherein the interlock member is made from one of martensite and spring steel.

12. A connector bracket for attaching an end of a first partition to a face of a second partition at a selected location between vertical side edges of the second partition, where the second partition includes a horizontal frame member having a horizontal row of slots, comprising:

an L-shaped rigid member having a first horizontal leg and a first vertical leg, the first horizontal leg having hooks each with a notch therein, the first vertical leg being spaced from the notches and including a connector adapted for attachment to the end of the first partition; and an L-shaped interlock member having a second horizontal leg and a second vertical leg, the second horizontal and vertical legs laying on the first horizontal and vertical legs, respectively, the second horizontal leg having an interlock tab that extends adjacent a portion of one of the hooks, the interlock tab being configured to prevent the hooks from disengaging from the horizontal frame member when the hooks are engaged with selected ones of the slots, the second vertical leg being attached to the first vertical leg at a location spaced from the second horizontal leg, so that a portion of the second vertical leg can be flexed to move the interlock tab to a non-interlocked position spaced away from the hooks to fully reveal the hooks for engagement with selected ones of the slots, but the portion being resilient and configured to bias the interlock tab into a normally interlocked position adjacent to the hooks to prevent the hooks from being accidentally disengaged from the selected slots and further wherein the second vertical leg includes leg portions separated by a slot, the leg portions straddling the connector.

13. The connector bracket defined in claim 12 wherein the leg portions of the second vertical leg are sufficient in length to flex like a leaf spring in a manner permitting the second horizontal leg including the tab to move to the non-interlocked position when the hooks are initially positioned in the slots.

14. The connector bracket defined in claim 1 wherein the interlock tab includes opposing edges, and the hooks include a rear edge opposite the notch that lies between the opposing edges when the interlock member is in the interlocked position.

15. A furniture system for dividing an open area comprising:

a first partition including a horizontal frame member having a horizontal row of slots;

a second partition having a connector bracket at one end thereof attaching the second partition to the first partition at a selected location between vertical side edges of the first partition wherein the connector bracket further comprises:

an L-shaped rigid member having a first horizontal leg and a first vertical leg, the first horizontal leg having hooks each with a notch therein, the first vertical leg being spaced from the notches and including a connector adapted for attachment to the end of the second partition; and an L-shaped interlock member having a second horizontal leg and a second vertical leg, the second horizontal and vertical legs laying on the first horizontal and vertical legs, respectively, the second horizontal leg having an interlock tab that extends adjacent a portion of one of the hooks, the interlock tab being configured to prevent the hooks from disengaging from the horizontal frame member when the hooks are engaged with selected ones of the slots, the second vertical leg being attached to the first vertical leg at a location spaced from the second horizontal leg, so that a portion of the second vertical leg can be flexed to move the interlock tab to a non-interlocked position spaced away from the hooks to fully reveal the hooks for engagement with selected ones of the slots, but the portion being resilient and configured to bias the interlock tab into a normally interlocked position adjacent to the hooks to prevent the hooks from being accidentally disengaged from the selected slots.

16. The furniture system defined in claim 15 including a fastener extending from the end of the second partition threadably into engagement with the connector on the rigid member of the connector bracket.

17. An apparatus for attachment to an existing partition having a face and a horizontal frame member defining a horizontal row of slots along the face, comprising:

an off-module partition having an end for positioning at a selected location between opposing vertical side edges of the existing partition; and a connector bracket for interconnecting the end of the off-module partition to the face of the existing partition, comprising:

a rigid member having a first leg and a second leg, the first leg having hooks each with a notch therein, the second leg being spaced from the notches and engaging the end of the off-module partition and secured thereto; and an interlock member having a third leg and a fourth leg, the third and fourth legs laying adjacent the first and second legs, respectively, the third leg having an interlock tab that is adjacent to at least one of the hooks, the interlock tab being configured to prevent the hooks from disengaging from the horizontal frame member when the hooks are engaged with selected ones of the slots, the fourth leg including a resilient portion longitudinally flexible with respect to a longitudinal plane of the off-module partition attached to the second leg at a location spaced from the third leg, so that a portion of the fourth leg can be flexed to longitudinally move the interlock tab to a non-interlocked position spaced away from the hooks to fully reveal the hooks for engagement with selected ones of the slots, the resilient portion configured to bias the interlock tab into a normally interlocked position adjacent the hooks to prevent the hooks from being accidentally disengaged from the selected slots.

18. An apparatus for attachment to an existing partition having a face and a horizontal frame member defining a horizontal row of slots along the face, comprising:

an off-module partition having an end for positioning at a selected location between opposing vertical side edges of the existing partition; and a connector bracket for interconnecting the end of the off-module partition to the face of the existing partition, comprising:

a rigid L-shaped member having a first leg and a second leg, the first leg having hooks each with a notch therein, the second leg being spaced from the notches and engaging the end of the off-module partition and secured thereto; and an interlock member having a third leg and a fourth leg, the third and fourth legs laying adjacent the first and second legs, respectively, the third leg having an interlock tab that is adjacent to at least one of the hooks, the interlock tab being configured to prevent the hooks from disengaging from the horizontal frame member when the hooks are engaged with selected ones of the slots, the fourth leg being attached to the second leg at a location spaced from the third leg, so that a portion of the fourth leg can be flexed to move the interlock tab to a non-interlocked position spaced away from the hooks to fully reveal the hooks for engagement with selected ones of the slots, but the portion being resilient and configured to bias the interlock tab into a normally interlocked position adjacent the hooks to prevent the hooks from being accidentally disengaged from the selected slots.

19. The apparatus defined in claim 18 wherein the second leg of the rigid member includes marginal material defining a hole, and a fastener extending from the end of the off-module partition into the hole to retain the connector bracket to the off-module partition.

20. The apparatus defined in claim 19 wherein the marginal material is extruded to form an elongated cylindrically-shaped surface adapted to threadably engage the fastener.

21. A connector bracket for attaching an end of a first partition to a face of a second partition at a selected location between vertical side edges of the second partition, where the second partition includes a horizontal frame member having a horizontal row of slots, comprising:

a rigid member having a first leg and a second leg extending at an angle to the first leg, the first leg having hooks, the second leg including marginal material elongated and threaded to form an elongated surface for receiving a threaded fastener; and an interlock member having an interlock tab that extends adjacent at least a portion of one of the hooks, the interlock tab being configured to prevent the hooks from disengaging from the horizontal frame member when the hooks are engaged with selected ones of the slots, the interlock member being attached to the second leg at a location spaced from the hooks, so that a portion of the interlock member can be flexed to move the interlock tab to a non-interlocked position spaced away from the hooks to fully reveal the hooks for engagement with selected ones of the slots, but the portion being resilient and configured to bias the interlock tab into a normally interlocked position adjacent the hooks to prevent the hooks from being accidentally disengaged from the selected slots.

22. The connector bracket defined in claim 21 wherein the second leg includes a threaded member having a threaded tubular section forming the marginal material, and further having a washered end attached to a flat area on the second leg.

23. A method of interconnecting an off-module partition to an existing partition where the existing partition has a face and opposing vertical side edges, and further has a horizontal frame member having a horizontal row of slots therein, comprising steps of:

providing an off-module partition with an end;

providing a connector having a rigid member including hooks for selective attachment to the slots and including an apertured end opposite from the hooks constructed to receive a fastener, the connector further having a resilient interlock member with an interlock tab configured to interlockingly engage the horizontal frame member and biased to a normally interlocked position;

attaching the connector to the existing partition by extending the hooks into engagement with selected slots, and then sliding the connector horizontally laterally to engage the hooks with the selected slots;

flexing the resilient interlock member longitudinally from an interlocked position and against its normal bias to a non-interlocked position as the hooks are inserted, so that an interlock tab on the interlock member does not interfere with inserting the hooks, and then longitudinally moving the interlock member from the non-interlocked position back to the interlocked position after the hooks are laterally seated in the selected slots to interlock the connector in the existing partition; and extending a fastener into the apertured end to connect the end of the off-module partition to the connector and in turn to the existing partition.

* * * * *